US009669954B2

(12) United States Patent
Ferretti

(10) Patent No.: US 9,669,954 B2
(45) Date of Patent: Jun. 6, 2017

(54) METHOD AND APPARATUS FOR FEEDING TUBULAR BLANKS TO A PACKAGING MACHINE

(75) Inventor: Maurizio Ferretti, Hong Kong (CN)

(73) Assignee: I.M.A. INDUSTRIA MACCHINE AUTOMATICHE S.P.A., Ozzano dell' Emilia (BO) (IT)

( * ) Notice: Subject to any disclaimer, the term of this patent is extended or adjusted under 35 U.S.C. 154(b) by 620 days.

(21) Appl. No.: 14/236,744

(22) PCT Filed: Aug. 1, 2012

(86) PCT No.: PCT/EP2012/065081

§ 371 (c)(1),
(2), (4) Date: Feb. 3, 2014

(87) PCT Pub. No.: WO2013/017640

PCT Pub. Date: Feb. 7, 2013

(65) Prior Publication Data

US 2014/0165510 A1 Jun. 19, 2014

(30) Foreign Application Priority Data

Aug. 4, 2011 (IT) ..... BO2011A0486

(51) Int. Cl.
*B65B 41/04* (2006.01)
*B65B 43/30* (2006.01)

(52) U.S. Cl.
CPC ..... *B65B 41/04* (2013.01); *B65B 43/305* (2013.01); *B31B 2201/027* (2013.01); *B31B 2201/287* (2013.01)

(58) Field of Classification Search
CPC ..... B65B 43/30; B65B 43/265; B65B 43/305; B31B 1/80; B31B 1/76; B31B 1/06; B31B 2201/287
(Continued)

(56) References Cited

U.S. PATENT DOCUMENTS 2,743,651 A * 5/1956 Wilcox ..... B31B 1/06 493/136
3,633,470 A * 1/1972 Bingham ..... B31B 1/78 493/310
(Continued)

FOREIGN PATENT DOCUMENTS

DE 30 10 891 A1 10/1981
EP 0 693 425 A2 1/1996
(Continued)

*Primary Examiner* — Thanh Truong
*Assistant Examiner* — Dariush Seif
(74) *Attorney, Agent, or Firm* — McGlew and Tuttle, P.C.

(57) ABSTRACT

An apparatus for feeding tubular blanks to a packaging machine includes a collecting group (10) provided with a first gripping member (11), suitable to grip single flat-folded tubular blanks (2) at a first face, and an opening group (20) provided with a second gripping member (21), suitable to grip the blanks (2) at a second face. The collecting group (10) includes a drive mechanism (12, 15) provided with a first arm (12) tilting under control of motor members (5), and with a second arm (15), carrying the first gripping member (11), which is mounted tilting on the first arm (12), and which is axially slidable for imparting to the first gripping means (11) an alternated rototranslation motion. The opening group (20) includes support a structure (22) of the second gripping means (21) pivoted on said second arm (15) of the collecting group (10) and constrained to a pulling means (25).

11 Claims, 4 Drawing Sheets

(58) Field of Classification Search
USPC ..... 53/458, 564; 493/316; 414/798.9; 74/10.31, 22 R
See application file for complete search history.

(56) References Cited

U.S. PATENT DOCUMENTS 4,057,008 A * 11/1977 Hughes ..... B31B 1/06 493/310
4,072,090 A * 2/1978 Heisler ..... B31B 1/80 221/298
4,211,153 A * 7/1980 Walters ..... B31B 5/80 493/310
4,531,931 A * 7/1985 Dietrich ..... B31B 1/06 493/309
4,605,393 A * 8/1986 Krieger ..... B31B 1/06 271/95
4,629,446 A * 12/1986 Focke ..... B31B 1/80 271/91
5,019,029 A * 5/1991 Calvert ..... B65B 43/265 493/315
5,061,231 A * 10/1991 Dietrich ..... B65B 43/265 271/95
5,102,385 A * 4/1992 Calvert ..... B65B 43/305 493/315
5,104,369 A * 4/1992 Calvert ..... B65B 43/265 493/315
5,176,612 A * 1/1993 Calvert ..... B31B 1/06 493/315
5,207,630 A * 5/1993 Decker ..... B31B 5/80 493/313
5,234,314 A * 8/1993 Ganz ..... B65H 3/0808 414/797
5,473,868 A * 12/1995 Antonio ..... B65B 43/345 493/309
5,536,231 A * 7/1996 Nilsson ..... B31B 1/80 493/312
5,613,828 A * 3/1997 Haddow ..... B65B 43/305 414/798.9
5,662,577 A * 9/1997 Reuteler ..... B31B 5/80 493/315
5,715,657 A * 2/1998 Mondani ..... B31B 5/80 493/313
5,813,965 A * 9/1998 Mitchell ..... B31B 5/80 271/95
5,928,123 A * 7/1999 Davis, Jr. ..... B31B 1/80 493/313
6,050,063 A * 4/2000 Ford ..... B65B 43/305 493/315
6,913,568 B2 * 7/2005 Frank ..... B31B 5/80 493/309
6,960,157 B2 * 11/2005 Schackmuth ..... B65B 43/305 493/122
7,243,481 B2 * 7/2007 Draghetti ..... B31B 1/80 493/313
7,310,925 B2 * 12/2007 Monti ..... B65B 5/024 493/309
7,695,421 B2 * 4/2010 Ford ..... B65B 43/185 271/100
8,277,367 B2 * 10/2012 Jannin ..... B31B 1/80 493/309
2006/0189466 A1 * 8/2006 Tsutsui ..... B31B 1/80 493/206
2006/0243786 A1 * 11/2006 Martelli ..... B31B 1/06 232/35
2007/0072756 A1 * 3/2007 Monti ..... B65B 5/024 493/309
2007/0197364 A1 * 8/2007 Monti ..... B31B 1/06 493/316
2009/0264269 A1 * 10/2009 Monti ..... B31B 1/06 493/52

FOREIGN PATENT DOCUMENTS

EP 1 419 969 A1 5/2004
EP 2 108 505 A2 10/2009

* cited by examiner

METHOD AND APPARATUS FOR FEEDING TUBULAR BLANKS TO A PACKAGING MACHINE

TECHNICAL FIELD

The present invention regards a method and an apparatus for feeding tubular blanks to a packaging machine.

In particular the invention refers to a method and an apparatus for collecting cardboard tubular blanks prearranged in flat folded shape in a store, erecting such tubular shaped blanks and supplying them to a transport line of the packaging machine.

BACKGROUND ART

It has been known that many types of products are packaged in containers obtained from cardboard blanks supplied in a flat folded tubular shape, in the specific technical field also known as pre-stuck blanks not in volume. The flat folded blanks must be collected singularly and successively opened out and erected in the tubular shape to enable the insertion of the articles to be packaged.

In the packaging field, various typologies of apparatuses have been known which allow to pick up flat folded tubular blanks from a store, erect such blanks in a tubular shape and feed them to a transport line of the packaging machine, actuated stepwise to bring the opened blanks at the operating station where insertion of the articles to be packaged is carried out. Such apparatuses generally comprise gripping means suitable to grip single tubular blanks and to extract them singularly from a store, where the blanks are prearranged in a flat folded shape, and folder means suitable to open out the blanks in a tubular shape.

Patent application EP 2 108 505 illustrates a device for erecting flat folded tubular blanks comprising a collecting group provided with first gripping means which are mobile between a pick up station of single tubular blanks from a store and an opening station of single tubular blanks. In the opening station is arranged an opening group which is provided with second gripping means for gripping the single flat folded tubular blanks at a second face, opposite to the first face engaged by the first gripping means. The second gripping means are mobile between a gripping position of the single tubular blanks and an opening position, spaced from the gripping position. A folder member is used to progressively engage a free side of the single tubular blanks during the opening course, to complete the erecting of the tubular blanks.

Patent EP 1 419 969 illustrates a device for gripping and erecting cardboard blanks comprising an arm swinging between a first position, wherein it picks up a blank from a feeding station, and a second position, wherein it releases the same blank after having erected it. The swing arm carries first and second suction means which engage the blank on opposite surfaces. The first suction means are integral to the swing arm, while the second suction means are carried by a crown wheel sector which is meshed with a toothed wheel rotating on the swing arm. The toothed wheel is handled by a crank mechanism controlled by a four-bar linkage, suitably driven with a reciprocating drive motion.

The known solutions do not fully satisfy the current exigencies of the users. In fact, known apparatuses are in general complex from a point of view both constructional and functional. In particular, it is complained that such apparatuses require a plurality of members to operate in sequence in different operating stations to carry out the cited phases of picking up single blanks from the store where they are arranged flat folded, of opening and erecting the blanks and of feeding the opened blanks to the transport line of the packaging machine where is performed the insertion of the articles to be packaged. This obviously implies high costs, greater risks of failure and proportionally reduced speeds which limit the productivity of the packaging machines, further that difficulties in the use for the users.

DISCLOSURE

The task of the present invention is that of solving the aforementioned drawbacks, devising a method and an apparatus which allow to perform in a simple and fast manner the feeding of tubular blanks to a packaging machine, in particular allowing to pick up flat folded tubular blanks from a store, to erect such blanks in a tubular shape, and to feed them to a transport line of the packaging machine.

Within such a task, it is further scope of the invention that of providing an apparatus for feeding tubular blanks to a packaging machine that can be actuated by means of a single motorization, through simple motion transmission means.

Another scope of the invention is that of providing an apparatus for feeding tubular blanks to a packaging machine which allows an easy adjustment of the format of the containers to be produced.

Another scope of the invention is that of providing an apparatus for feeding tubular blanks to a packaging machine having a simple conception, a securely reliable functioning and versatile use, as well as relatively economic cost.

The cited scopes are attained, according to the present invention, by the apparatus and the method for feeding tubular blanks to a packaging machine according to claims 1 and 10.

According to the present invention, the apparatus for feeding tubular blanks to a packaging machine comprises a collecting group provided with a drive mechanism which shapes a crank and slotted link suitable to impart to the first gripping means of a tubular blank, picked up in a flat folded shape from a store, an alternated rototranslation motion on a longitudinal plane.

Preferably such a drive mechanism comprises a first arm tilting on said longitudinal plane, according to a first rotation axis, and a second arm, carrying said first gripping means, which is mounted tilting on said first arm, according to a second rotation axis, and is axially slidable with respect to a fixed point, to impart to said first gripping means said alternated rototranslation motion.

According to a feature of the invention, the apparatus comprises an opening group provided with support means for second gripping means pivoted on said second arm of the collecting group and constrained to pulling means suitable to determine, in suitable step relation with said alternated rototranslation motion of the first gripping means, an alternated angular rotation of said second gripping means to perform the gripping and erecting of the tubular blank.

According to a further feature of the present invention, the collecting group is driven by motor member comprising a crank provided with a connecting rod which receives the motion from a cam actuated in rotation by an electric motor and is suitable to transmit a tilting motion to a lever pivoted on said first rotation axis of the first arm of the collecting group.

The present invention also regards a method for feeding tubular blanks to a packaging machine which provides to transfer a tubular blank from a pick up station to a release station of the blank erected by means of a rototranslation motion of first gripping means, suitable to grip said blank at a first face, and to determine, in a suitable step relation with said rototranslation motion of the first gripping means, an alternated angular rotation of second gripping means, suitable to grip said tubular blank at a second face, to perform the gripping and erecting of said tubular blank.

DESCRIPTION OF DRAWINGS

Details of the invention shall be more apparent from the detailed description of a preferred embodiment of the apparatus for feeding tubular blanks to a packaging machine according to the invention, illustrated for indicative purposes in the attached drawings, wherein.

BEST MODE

Figure 1:
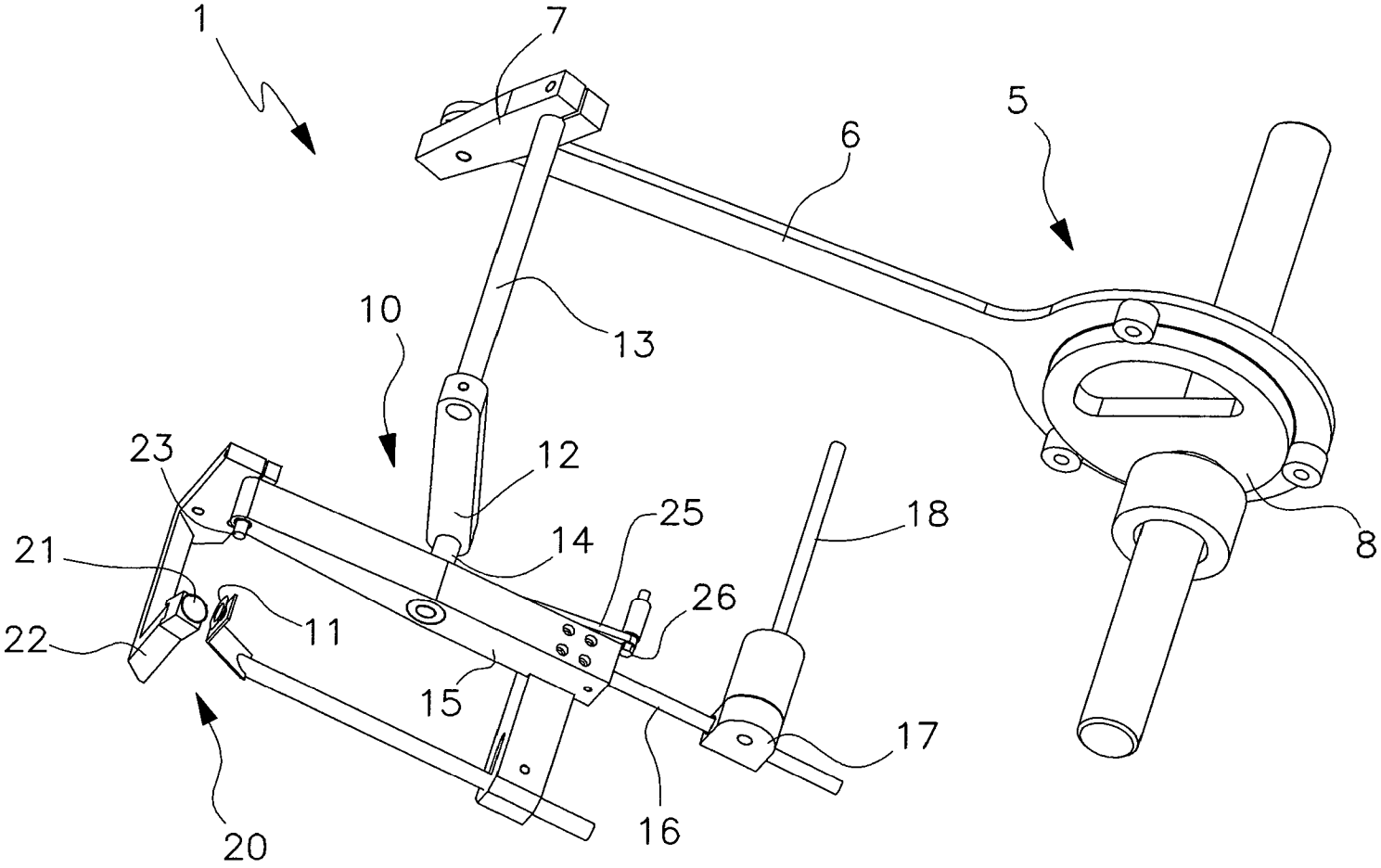
FIG. 1 shows a perspective view of the apparatus for feeding tubular blanks to a packaging machine.

With particular reference to such figures, the apparatus for feeding pre-stuck tubular blanks 2 to a packaging machine is indicated in its entirety with 1. More in detail, the tubular blanks 2 are prearranged in a flat folded form inside a store 3, from which they are picked up in ordered succession to be opened and fed to a transport line 4 of the packaging machine.

The apparatus 1 comprises a collecting group 10 provided with first gripping means 11 suitable to grip single flat folded tubular blanks 2 at a first face. The first gripping means 11 is suitably constituted by a suction cap member linked in a known way to suitable sucking means.

The collecting group 10 is provided with a drive mechanism of the first gripping means 11 suitable to determine a rototranslation motion of the same first gripping means 11, on a plane longitudinal to the transport line 4, between a station A for picking up a single flat folded tubular blank 2 from the store 3 and a station B for releasing the same blank 2, erected, that is brought in an opened form, on the transport line 4. Such a drive mechanism comprises a rocker arm (first arm) 12 which is actuated with tilting motion, in a rocker arm shape, on the aforesaid plane longitudinal to the transport line 4, upon control of suitable motor members 5. The rocker arm 12 is pivoted at one of its ends on a first rotation axis 13, at which it receives the alternated actuation motion from the aforesaid motor members 5; at the opposite end, the rocker arm 12 carries articulated, on a second rotation axis parallel to the first rotation axis 13, a connecting rod arm (second arm) 15, which substantially rotates, functioning as a connecting rod, on the same plane longitudinal to the transport line 4.

Figure 7:
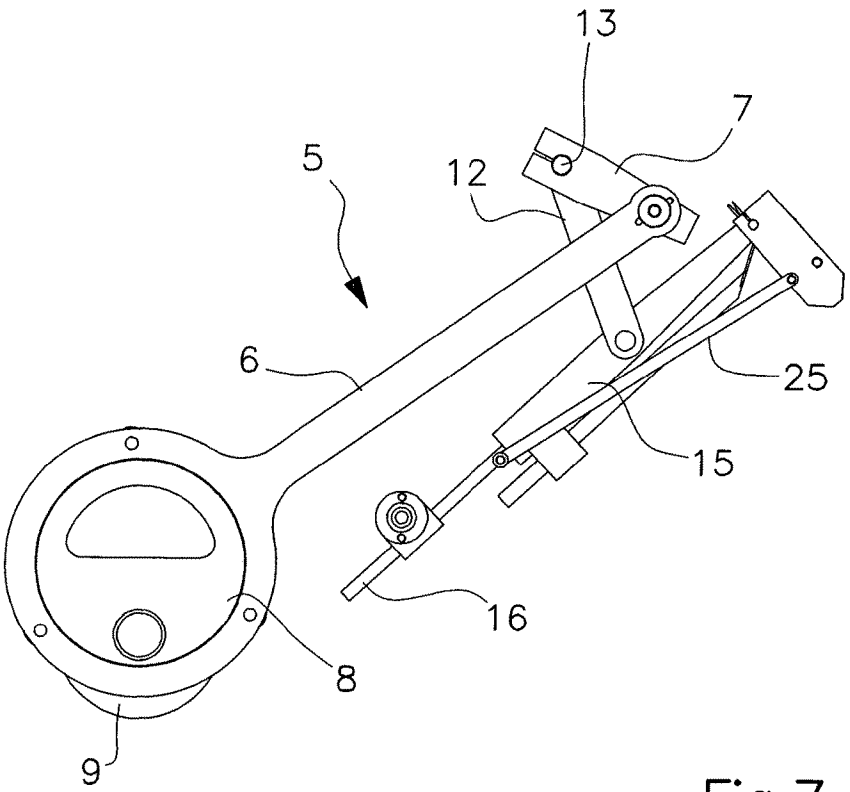
FIG. 7 shows a schematic side view of the motor members of the apparatus.

The motor members 5 preferably comprise a crank gear consisting of a connecting rod 6 which is suitable to transmit a tilting motion to a lever 7 which is pivoted at one of its ends on the aforesaid rotation axis 13 of the rocker arm 12 (see FIG. 7); the connecting rod 6 receives the motion from a cam 8 actuated in rotation by a suitable electric motor 9.

The connecting rod arm 15 of the collecting group 10 carries integral at one end the above said first gripping means 11, while at the opposite end axially extends shaping a rod 16 which is inserted sliding through a slider 17. The slider 17 is supported rotatable, on the same longitudinal plane, at a third rotation axis 18. Preferably the rotation axis 18 is slightly eccentric with respect to the guide hole of the rod 16 on the slider 17. Practically, the mechanism formed by the rocker arm 12 and by the connecting rod arm 15 shapes a sort of tilting crank and slotted link able to impart to the first gripping means 11 the aforesaid rototranslation motion.

It is to be observed that, in the gripping position on the first gripping means 11, the flat folded blank 2 is arranged with a plane almost orthogonal to the longitudinal axis of the connecting rod arm 15. Moreover, suitably, the first gripping means 11 is constrained to the connecting rod arm 15 by means of a support member 19 interchangeable depending on the format of the containers to be produced, that is, depending on the dimensions of the blanks 2.

To the collecting group 10 is articulated an opening group 20 provided with second gripping means 21 suitable to grip the single flat folded blanks 2 at a second face, opposite to the above said first face engaged by the first gripping means 11. The second gripping means 21 are similarly constituted by a suction cap member linked in a known way to suitable sucking means.

The opening group 20 is provided with support means 22 of the second gripping means 21 which are pivoted near the free end of the connecting rod arm 15, at a fourth rotation axis 23 parallel to the already cited axis 13, 14 and 18. The support means 22 consist substantially of a fork-shaped frame which, at a prong, is articulated, on the axis 23, to the connecting rod arm 15, while on the prong placed beside it carries the second gripping means 21. As better precised in the following, the rotation axis 23 of the support frame 22 is coaxial in use with the creasing line defined between the two adjacent faces of the blank 2 gripped respectively by the first and by the second gripping means 11, 21.

To the support frame 22 is hinged, according to an axis 24, an end of a drawing member 25 which at the opposite end is pivoted on an axis 26 fixed with respect to the framework of the machine. The drawing member 25 therefore is tilting with respect to the fixed axis 26, following the motion imparted to the support frame 22 by the connecting rod arm 15, and determines the corresponding angular rotation of the same support frame 22 on the axis 23.

The functioning of the apparatus for feeding tubular blanks turns out to be easy to understand from the preceding description.

Figure 2:
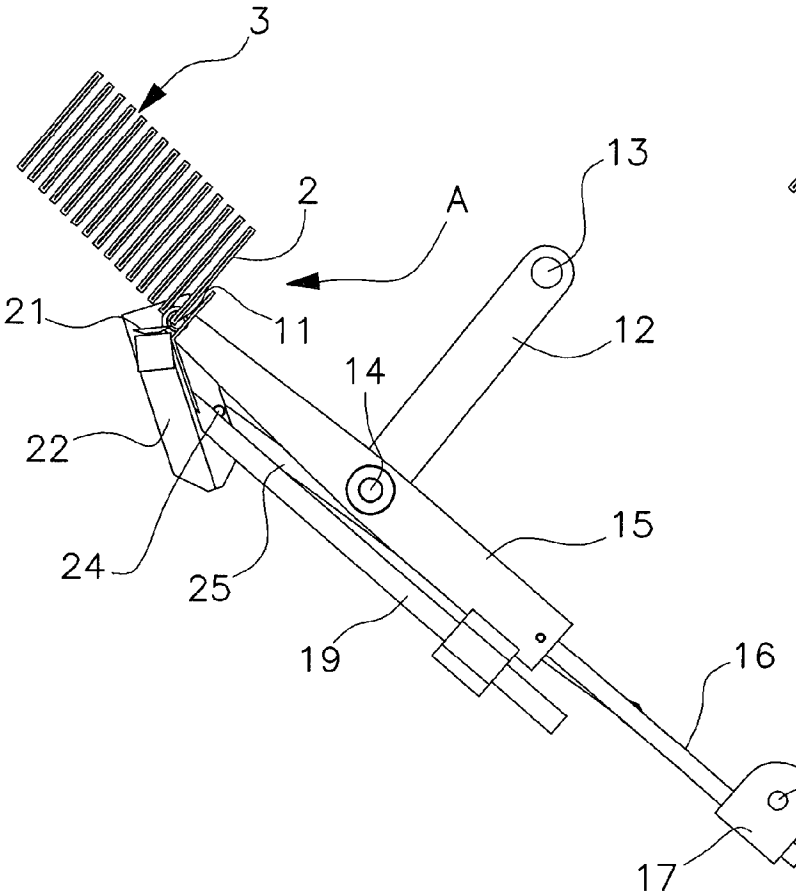

The collecting group 10 initially takes the first gripping means 11 into contact with the tubular blank 2 arranged at the front of the store 3, at the pick-up station A (FIG. 2). In particular, the first gripping means 11 is taken to get a grip on a first face of the flat folded blank 2, oriented towards the outside of the store 3.

It is to be observed that, in such step, the second gripping means 21 are kept by the relative support frame 22 in a position angled such as not to constitute an obstacle to the grip of the blank 2.

Figure 3:
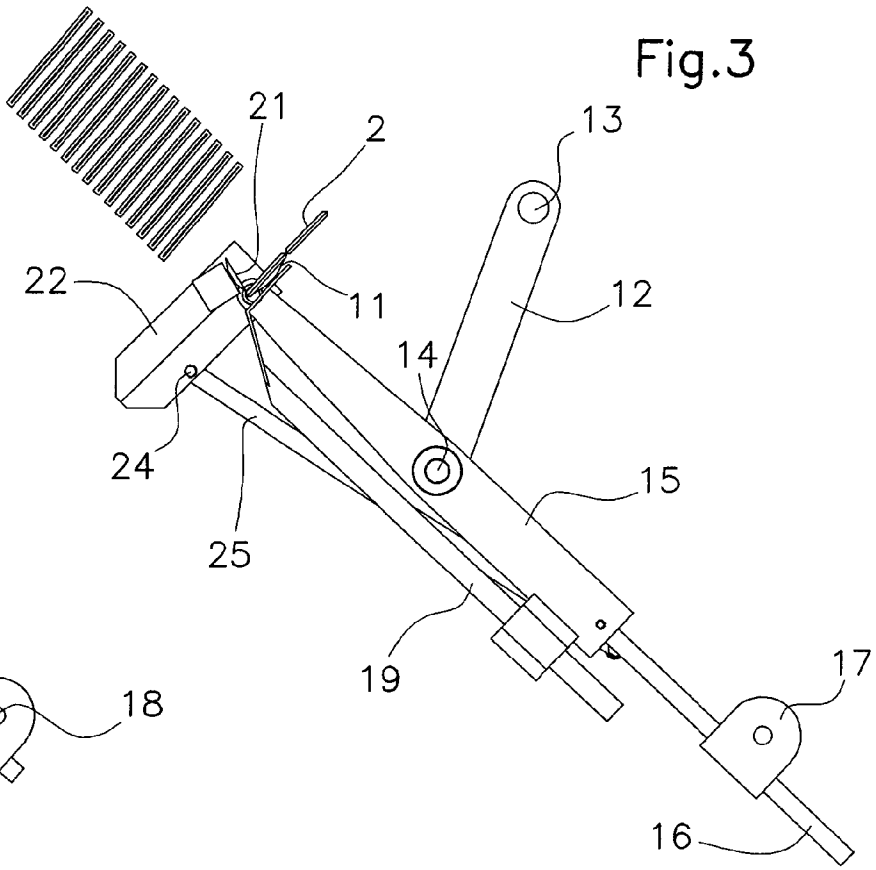
FIGS. 2-6 respectively show a schematic side view of an operating area of the apparatus in various operating steps.

The tubular blank 2 gripped by the first gripping means 11 is extracted from the store 3 after the tilting of the rocker arm 12 of the collecting group 10, which rotates angularly on the longitudinal plane, at the first rotation axis 13, towards the transport line 4 (FIG. 3). The angular rotation of the rocker arm 12 determines a corresponding angular rotation of the connecting rod arm 15 which is simultaneously forced to slide axially by effect of the engagement of the rod 16 in the slider 17. It is to be noted that such a combined motion of axial sliding of the connecting rod arm 15 and of rotation of the same connecting rod arm 15 with respect to the rotation centre defined by the axis 18 of the slider 17 determines the aforementioned rototranslation motion of the first gripping means 11.

In suitable step relation, the angular rotation of the support frame 22 of the opening group 20 determines the progressive approaching of the second gripping means 21 to the second face of the flat folded blank 2. Such angular rotation is imparted to the support frame 22 by the drawing member 25 pivoted on the fixed axis 26, with the rotation of the connecting rod arm 15 to which the frame 22 is articulated at the axis 23.

Figure 4:
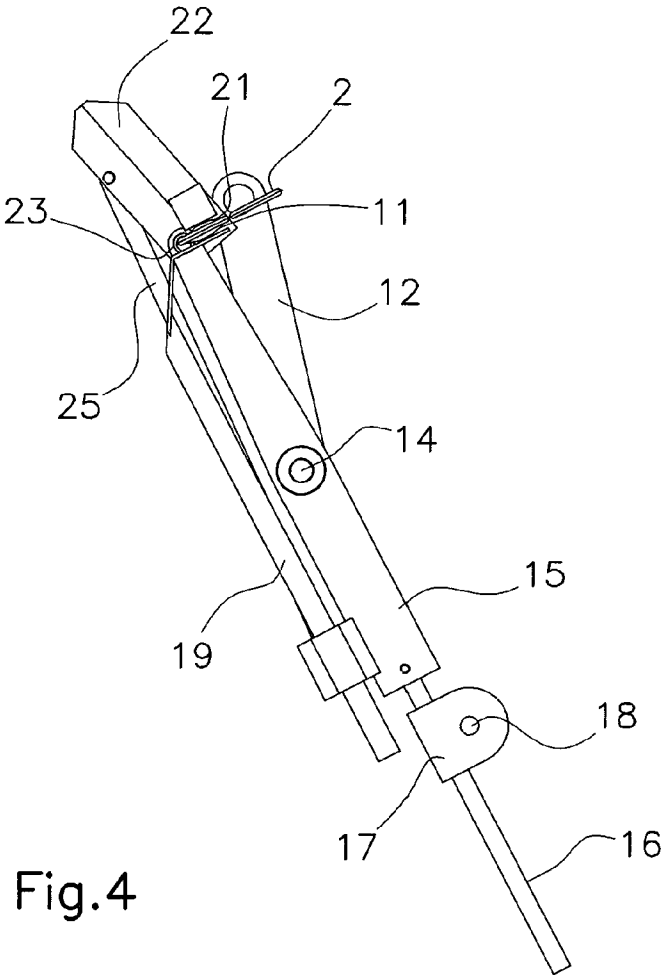

Upon completing such angular rotation of the support frame 22, the second gripping means 21 are brought in contact with the second face of the flat folded tubular blank 2 (FIG. 4). The tubular blank 2 results in such a way gripped by the gripping means 11 and 21 at two opposite faces, contiguous to each other.

It is to be observed that such a gripping condition of the tubular blank 2 by the first and second gripping means 11, 21, at two opposite and contiguous faces, is realized at the moment that the connecting rod arm 15 has reached a sort of lower deadlock of its own axial sliding inside the slider 17 and results substantially aligned to the rocker arm 12. Starting from such lower deadlock, the connecting rod arm 15 inverts the direction of rotation of the support frame 22 of the second gripping means 21. Practically, the connecting rod arm 15 is axially slidable, with alternated motion, between a first upper deadlock, at the pick-up station A, of maximal angular spacing of the gripping means 11 and 21 to enable the grip of the blank 2 from the store 3, a lower deadlock, substantially aligned with the rocker arm 12, of reciprocal approaching of the gripping means 11 and 21 which grip the blank 2 on opposite and adjacent faces, and a second upper deadlock, at the release station B, where the gripping means 11 and 21 are substantially arranged squaring to determine the erecting of the blank 2 gripped on two adjacent faces.

Figure 5:
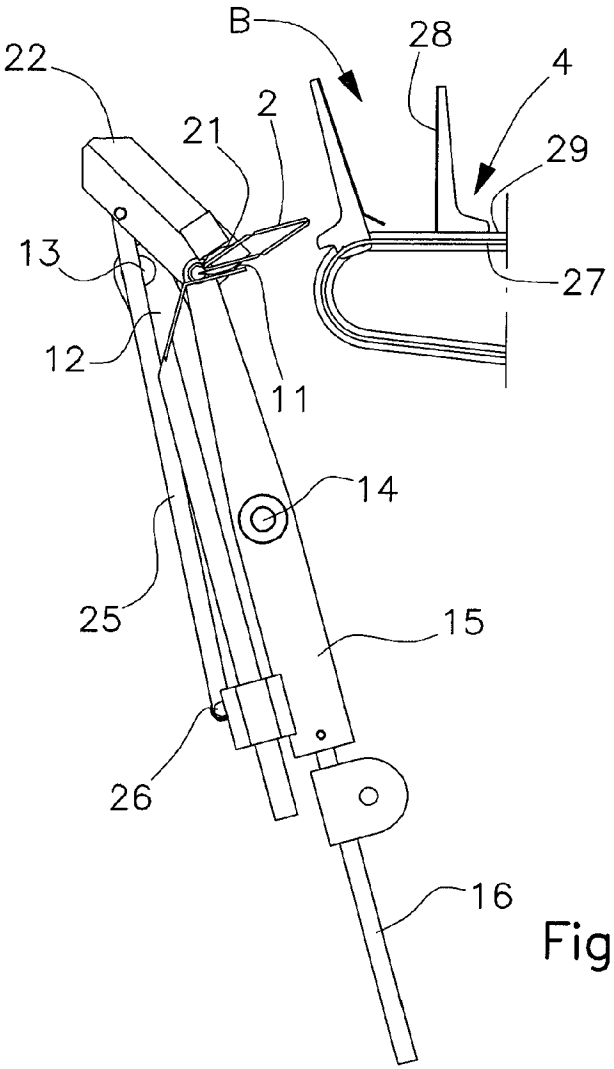

Continuing the angular rotation of the rocker arm 12, the progressive opening of the tubular blank 2 is thus determined (FIG. 5). Such opening is determined by the relative angular rotation of the cited opposite faces of the tubular blank 2 respectively gripped by the first and by the second gripping means 11, 21, with respect to a rotation centre defined practically by the creasing line which joins both faces, until completing the erecting of the same blank 2. This is allowed, in particular, by the fact that such creasing line is aligned with the axis 23 with respect to which rotates the support frame 22 of the second gripping means 21.

Figure 6:
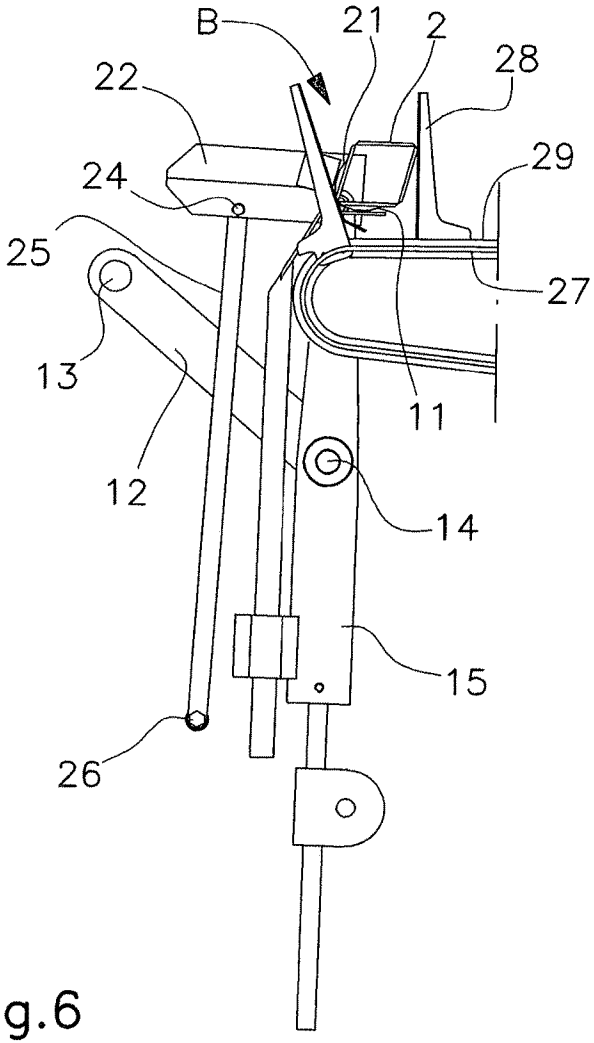

The erected blank 2 is then transferred to the transport line 4, at the release station B (FIG. 6). The transport line 4 is made, for example, in a known way, of a couple of conveyor belts 27 placed side by side, carrying fitted a series of abutment members 28 regularly spaced, between which are defined respective seats for housing the erected tubular blanks 2. The blanks 2 move on sliding guides 29 arranged above the active branch of the conveyor belts 27.

In practice, in the release station B, arranged substantially at the inlet of the transport line 4, the tubular blank 2, still retained by the first gripping means 11 and the second gripping means 21 on both contiguous faces arranged squaring, is taken supported on the abutment members 28 arranged downstream, according to the feed direction of the transport line 4. The blank 2 is then released simultaneously by the first gripping means 11 and the second gripping means 21 at the arrival of the successive abutment members 28 which block the same blank 2 in the erected configuration.

After releasing the blank, the rocker arm 12 of the collecting group 10 performs the return course to prearrange itself for picking up a successive blank from the store 3, moving with itself the opening group 20.

The method and the apparatus object of the invention therefore reach the scope of performing in a simple and fast manner the steps of picking up flat folded tubular blanks from a store, erecting such blanks in a tubular form and feeding them to a transport line of the packaging machine.

Such a result is obtained substantially thanks to the inventive idea of transferring the tubular blanks from a pick-up station from a store to a release station at a transport line by means of an alternated rototranslation motion of first gripping means of the blanks, in combination with an alternated angular rotation of second gripping means suitable to perform the grip and the erecting of the same tubular blanks.

A feature of the invention consists in that the aforesaid alternated rototranslation motion of the first gripping means is realized through a collecting group provided with a drive mechanism which shapes a tilting crank and slotted link.

Another feature of the invention consists in that the aforesaid alternated angular rotation of the second gripping means is realized through an opening group comprising means for supporting the second gripping means pivoted to a fixed axis.

A further advantage offered by the apparatus of the invention consists in that it provides a single motorization which actuates the cited collecting group and, thanks to a particular kinetic chain, the opening group of the tubular blanks. Such motorization, simple per se from both a structural and a functional point of view, provides a crank gear provided with a connecting rod which receives the motion from a cam actuated in rotation by an electric motor and is suitable to transmit a tilting motion to a lever pivoted on the rotation axis of the first arm of the collecting group.

In practice, picking up, opening and transferring the tubular blanks are performed through one single movement, actuated by the aforesaid motorization, with obvious advantage for the functional simplicity and the operating speed of the apparatus.

A specific advantage offered by the apparatus to the users is given by the simplicity with which it is possible to perform the adjustment operations, for example format change, as well as maintaining the correct operating conditions.

The apparatus described for indicative purposes is susceptible of numerous variations and modifications according to the various exigencies.

In practice, the embodiment of the invention, the materials used, as well as the shape and dimensions, may vary depending on the requirements.

Should the technical characteristics mentioned in each claim be followed by reference signs, such reference signs were included strictly with the aim of enhancing the understanding the claims and hence they shall not be deemed restrictive in any manner whatsoever on the scope of each element identified for exemplifying purposes by such reference signs.

The invention claimed is:

1. An apparatus for feeding tubular blanks to a packaging machine, the apparatus comprising:

a collecting group, provided with a first gripping member for gripping single flat-folded tubular blanks at a first face, and alternatively mobile between a station for picking up said single tubular blanks from a store, wherein said tubular blanks are arranged flat folded, and a station for releasing said single tubular blanks erected, at a transport line; and an opening group, provided with a second gripping member for gripping said single flat folded tubular blanks at a second face, opposite to said first face gripped by said first gripping member, to perform the erecting of the tubular blanks, said collecting group comprising a drive mechanism provided with a first arm tilting on a vertical plane parallel to said transport line, about a first rotation axis, under control of motor members, and with a second arm, carrying said first gripping member, said second arm being mounted tilting on said first arm, about a second rotation axis, and said second arm being slidable axially with respect to a fixed point, to impart to said first gripping member an alternated rototranslation motion on said longitudinal plane, and said opening group comprising a support member for said second gripping member pivoted on said second arm of the collecting group, about a further rotation axis, and constrained to a pulling member for causing, in relation with said alternated rototranslation motion of the first gripping member, an alternated angular rotation of said second gripping member to perform the gripping and erecting of said tubular blanks, wherein said further rotation axis of said support member for the second gripping member is coaxial with a creasing line defined between said first face and said second face of a tubular blank respectively gripped by said first gripping member and by the second gripping member.

2. An apparatus according to claim 1, wherein said drive mechanism of the collecting group is a slider crank mechanism for imparting to said first gripping member said alternated rototranslation motion on said plane.

3. An apparatus according to claim 2, wherein said second arm of the collecting group carries at one end said first gripping member, at an opposite end said second arm being inserted slidable with a portion thereof through a slider supported slidable, on said plane, at said fixed point.

4. An apparatus according to claim 1, wherein said second arm of the collecting group carries at one end said first gripping member, at an opposite end said second arm being inserted slidable with a portion thereof through a slider supported slidable, on said plane, at said fixed point.

5. An apparatus according to claim 4, wherein said fixed point is eccentric with respect to a guiding hole of said portion of the second arm on said slider.

6. An apparatus according to claim 1, wherein said motor members comprise a crank mechanism provided with a connecting rod which receives motion from a cam actuated in rotation by an electric motor and is suitable to transmit a tilting motion to a lever pivoted on said first rotation axis of the first arm of the collecting group.

7. An apparatus according to claim 1, wherein said support member for the second gripping member comprises a fork shaped frame which is pivoted at one end thereof in proximity of a free end of said second arm of the collecting group, at said further rotation axis, and at an opposite end said fork shaped frame carries said second gripping member.

8. An apparatus according to claim 1, wherein said pulling member is hinged at one end, according to a first fixed axis, to said support member for the second gripping member and at an opposite end said pulling member is pivoted on a second fixed axis, so as to result tilting with respect to said second fixed axis.

9. An apparatus according to claim 1, wherein said second arm of the collecting group is slidable axially with respect to said fixed point, with an alternated motion, between a first upper deadlock, at said pick-up station, furthermost from said first gripping member and said second gripping member, a lower deadlock, substantially aligned with said first arm of the collecting group, of reciprocal approaching of said first gripping member and said second gripping member, and a second upper deadlock, at said release station, wherein said first gripping member and said second gripping member are arranged substantially ninety degrees to cause the erecting of a blank.

10. An apparatus for feeding tubular blanks to a packaging machine, the apparatus comprising:

a collecting group, provided with a first gripping member for gripping single flat-folded tubular blanks at a first face, and alternatively mobile between a station for picking up said single tubular blanks from a store, wherein said tubular blanks are arranged flat folded, and a station for releasing said single tubular blanks erected, at a transport line; and an opening group, provided with a second gripping member for gripping said single flat folded tubular blanks at a second face, opposite to said first face gripped by said first gripping member, to perform the erecting of the tubular blanks, said collecting group comprising a drive mechanism provided with a first arm tilting on a vertical plane parallel to said transport line, about a first rotation axis, under control of motor members, and with a second arm, carrying said first gripping member, said second arm being mounted tilting on said first arm, about a second rotation axis, and said second arm being slidable axially with respect to a fixed point, to impart to said first gripping member an alternated rototranslation motion on said longitudinal plane, and said opening group comprising a support member for said second gripping member pivoted on said second arm of the collecting group, about a further rotation axis, and constrained to a pulling member for causing, in relation with said alternated rototranslation motion of the first gripping member, an alternated angular rotation of said second gripping member to perform the gripping and erecting of said tubular blanks, wherein said pulling member is hinged at one end to said support member for the second gripping member and at an opposite end said pulling member is pivotable so as to result tilting with respect to a fixed axis.

11. An apparatus for feeding tubular blanks to a packaging machine, the apparatus comprising:

a collecting group, provided with a first gripping member for gripping single flat-folded tubular blanks at a first face, and alternatively mobile between a station for picking up said single tubular blanks from a store, wherein said tubular blanks are arranged flat folded, and a station for releasing said single tubular blanks erected, at a transport line; and an opening group, provided with a second gripping member for gripping said single flat folded tubular blanks at a second face, opposite to said first face gripped by said first gripping member, to perform the erecting of the tubular blanks, said collecting group comprising a drive mechanism provided with a first arm tilting on a vertical plane parallel to said transport line, about a first rotation axis, under control of motor members, and with a second arm, carrying said first gripping member, said second arm being mounted tilting on said first arm, about a second rotation axis, and said second arm being slidable axially with respect to a fixed point, to impart to said first gripping member an alternated rototranslation motion on said longitudinal plane, and said opening group comprising a support member for said second gripping member pivoted on said second arm of the collecting group, about a further rotation axis, and constrained to a pulling member for causing, in relation with said alternated rototranslation motion of the first gripping member, an alternated angular rotation of said second gripping member to perform the gripping and erecting of said tubular blanks, wherein said second arm of the collecting group is slidable axially with respect to said fixed point, with an alternated motion, between a first upper deadlock, at said pick-up station, furthermost from said first gripping member and said second gripping member, a lower deadlock, substantially aligned with said first arm of the collecting group, of reciprocal approaching of said first gripping member and said second gripping member, and a second upper deadlock, at said release station, wherein said first gripping member and said second gripping member are arranged substantially ninety degrees to cause the erecting of a blank.

* * * * *